US005787968A

United States Patent [19]

Lauener

[11] Patent Number: 5,787,968

[45] Date of Patent: Aug. 4, 1998

[54] MOVABLY MOUNTED SIDE DAM AND AN ASSOCIATED METHOD OF SEALING THE SIDE DAM AGAINST THE NOZZLE OF A BELT CASTER

[75] Inventor: Wilhelm F. Lauener, Gerlafingen/SO, Switzerland

[73] Assignee: Larex A.G., Solothurn, Switzerland

[21] Appl. No.: 566,776

[22] Filed: Dec. 28, 1995

[51] Int. Cl.[6] ..... B22D 11/06

[52] U.S. Cl. ..... 164/481; 164/431

[58] Field of Search ..... 164/481, 479, 164/430, 431, 432, 435

[56] References Cited

U.S. PATENT DOCUMENTS

| | | | |
|---|---|---|---|
| 3,759,313 | 9/1973 | Gyongyos | 164/430 X |
| 4,239,081 | 12/1980 | Kranz . | |
| 4,601,324 | 7/1986 | Artz et al. . | |
| 4,620,583 | 11/1986 | Koide et al. . | |
| 4,694,899 | 9/1987 | Wood et al. . | |
| 4,785,873 | 11/1988 | Lauener . | |
| 4,794,978 | 1/1989 | Lauener . | |
| 4,798,315 | 1/1989 | Lauener . | |
| 4,854,371 | 8/1989 | Katahira et al. . | |
| 4,869,310 | 9/1989 | Yanagi et al. . | |
| 4,934,441 | 6/1990 | Wood et al. . | |
| 4,964,456 | 10/1990 | Lauener . | |

FOREIGN PATENT DOCUMENTS

| | | | |
|---|---|---|---|
| 864035 | 6/1978 | Belgium . | |
| 62-207537 | 9/1987 | Japan | 164/430 |
| 63-149046 | 6/1988 | Japan | 164/430 |
| 63-278645 | 11/1988 | Japan | 164/431 |
| 64-75150 | 3/1989 | Japan | 164/431 |
| 1-99749 | 4/1989 | Japan | 164/432 |
| 1-130850 | 5/1989 | Japan | 164/430 |

OTHER PUBLICATIONS

Translation of Belgian Patent 864,035 Published Jun. 16, 1978.

*Primary Examiner*—J. Reed Batten, Jr.
*Attorney, Agent, or Firm*—David V. Radack; David W. Brownlee; Eckert Seamans Cherin & Mellott, LLC

[57] ABSTRACT

The side dam is movably mounted to the caster so that it can be securely sealed against the nozzle to resist molten metal in the mold from leaking between the nozzle and the side dam. An adjustment system adjusts the pressure of the side dam against the nozzle in order to insure a tight secure seal of the side dam against the nozzle while at the same time adjusting the pressure of the side dam against the nozzle so that excessive undesired frictional wear of the nozzle is avoided.

29 Claims, 6 Drawing Sheets

MOVABLY MOUNTED SIDE DAM AND AN ASSOCIATED METHOD OF SEALING THE SIDE DAM AGAINST THE NOZZLE OF A BELT CASTER

BACKGROUND OF THE INVENTION

This invention relates to a movably mounted side dam and an associated method of sealing the side dam against the nozzle of a belt caster.

Casters for continuously casting molten metal into metal products are known. One type of caster is known as a twin belt caster, see, U.S. Pat. No. 4,964,456. Typically, molten metal from a furnace is introduced into a tundish and is then subsequently fed to a nozzle. The molten metal flows through the nozzle and into a mold formed by a pair of opposed belts and a pair of opposed side dams. The molten metal solidifies in the mold and emerges as a cast metal product which is subsequently moved out of the mold at casting speed.

In order to insure that molten metal does not leak from the mold to between the side dam and the nozzle, it is important that the side dam seal against the nozzle. However, because the nozzle is made of a refractory material, the side dam should not press so hard against the nozzle to cause undesired frictional wearing of the nozzle material.

U.S. Pat. No. 4,794,978 discloses a side dam having a plurality of blocks mounted to a chain which orbits about two pulleys. The blocks of the side dam are stated to seal against the nozzle due to their straight path. It has been found, however, that despite the effectiveness of the system disclosed in this patent, that it would be desirable to provide a mechanical system that insures a tight seal between the side dam and the nozzle while at the same time insuring that the pressure placed on the nozzle by the side dam is not so great as to cause undesired excessive frictional wear on the nozzle.

SUMMARY OF THE INVENTION

The side dam of the invention and the associated method have met or exceeded the above-mentioned needs. The side dam is for a caster having a nozzle for delivering molten metal into a mold. The side dam is movably mounted to the caster so that it can be securely sealed against the nozzle to resist molten metal in the mold from leaking between the nozzle and the side dam.

The method of the invention involves providing a movably mounted side dam and moving the side dam so that a secure seal is formed between the nozzle and the side dam.

The invention further provides a mechanical means for adjusting the pressure of the side dam against the nozzle so that a secure seal is created between the side dam and the nozzle while at the same time the pressure is not so great as to cause undesired frictional wear of the nozzle. The mechanical means consists of (i) a cylinder secured to the caster, the cylinder defining a chamber for receiving a gas from a gas supply means; (ii) a piston operatively associated with the cylinder; (iii) an arm having one portion connected to the piston and another portion connected to the side dam; (iv) a spring disposed in the cylinder, the spring biasing the piston and the arm so that the side dam presses against the nozzle; and (v) a tube disposed between the side dam and the nozzle, the tube having a gas receiving end for receiving gas from the gas supply means and an exhaust end.

The mechanical means operates by introducing gas from the gas supply means into both the chamber and the tube so that the side dam is securely sealed to the nozzle while at the same time not so tightly sealed so that undesired excessive frictional wear is caused to the nozzle.

BRIEF DESCRIPTION OF THE DRAWINGS

A full understanding of the invention can be gained from the following description of the preferred embodiment when read in conjunction with the accompanying drawings in which.

DETAILED DESCRIPTION

As used herein, the term "metal product" means primarily clad or unclad strip or slab made substantially of one or more metals, including without limitation, aluminum and aluminum alloys and can also include, in a broader sense, clad or unclad bar, foil or rod.

This invention relates to side dams for casters in which molten metal is formed into a metal product. As is known, there are several types of casters, such as roll casters, block casters and belt casters. These casters can be either horizontally or vertically oriented. Although the following detailed description focuses on the side dam of the invention as used on a vertical twin belt caster, it will be appreciated that the invention is not so limited and can be used on other types of casters where a side dam is required or desirable.

Figure 1:
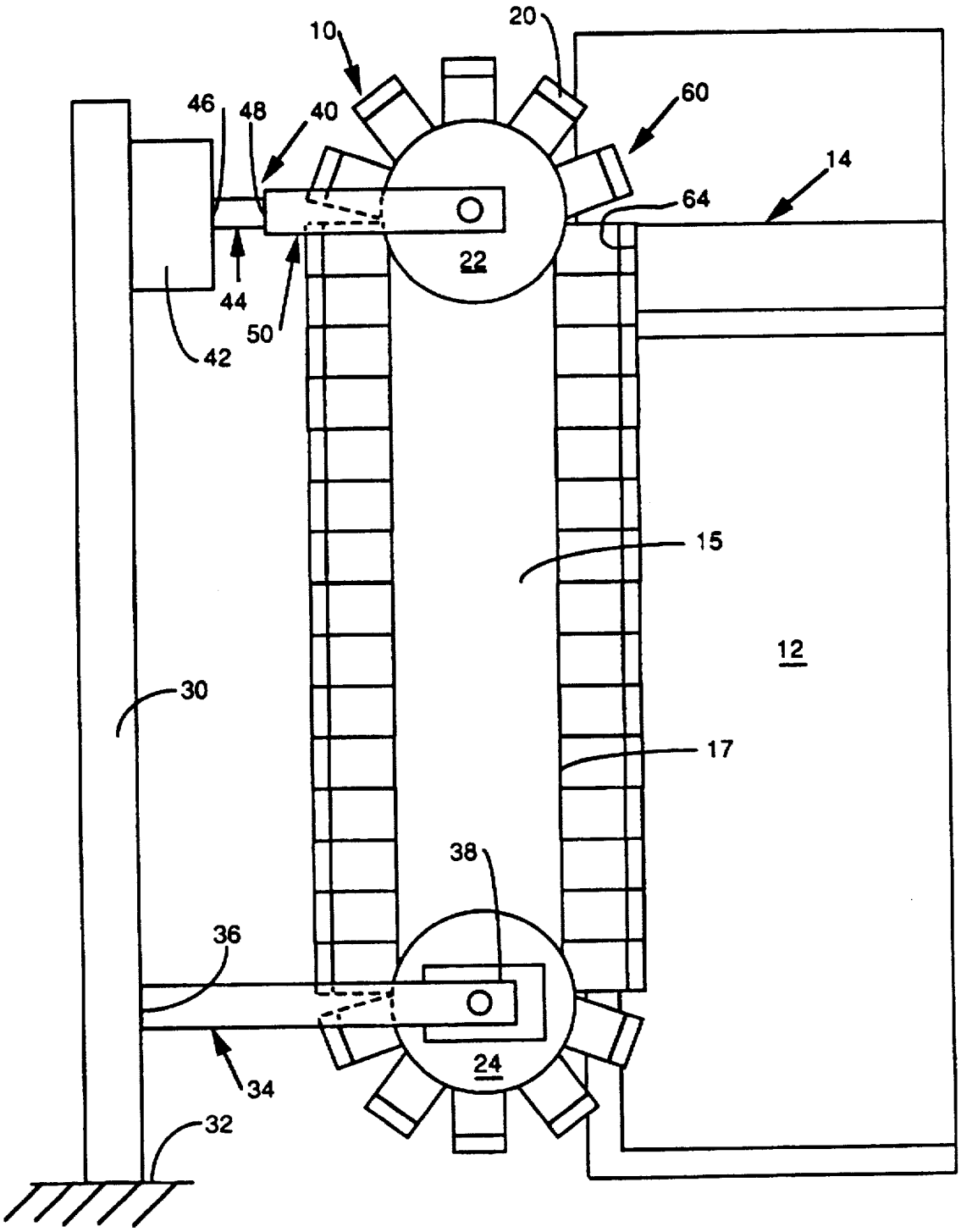
FIG. 1 shows a side-elevational view of a side dam of the invention in use with a twin belt caster.

Referring now to FIG. 1, a portion of a vertical twin belt caster is shown. As is known, the twin belt caster consists of a pair of opposed movable belts (not shown) that along with a pair of opposed movable side dams (side dam 10 being shown and the opposed side dam not being shown) form a mold 12 into which molten metal is cast. The molten metal is delivered from a furnace into a trough and then into a tundish (not shown) and then into casting nozzle 14. The tundish and nozzle 14 can be constructed similarly to the nozzle shown in U.S. Pat. No. 4,798,315, the disclosure of which is expressly incorporated herein by reference. The molten metal solidifies into a metal product which is then moved out of the mold at casting speed by means of the belts and side dams.

For a more detailed description of a vertical twin belt caster, see U.S. Pat. No. 4,964,456, the disclosure of which is expressly incorporated herein by reference.

The side dam 10 consists of an endless chain-like system including a frame 15 and orbiting means consisting of a chain 17 on which a plurality of blocks, such as block 20, are guided over two pulleys 22 and 24. For a more detailed description of the operation and structure of the side dam 10, see U.S. Pat. No. 4,794,978, which is expressly incorporated herein by reference.

Figure 2:
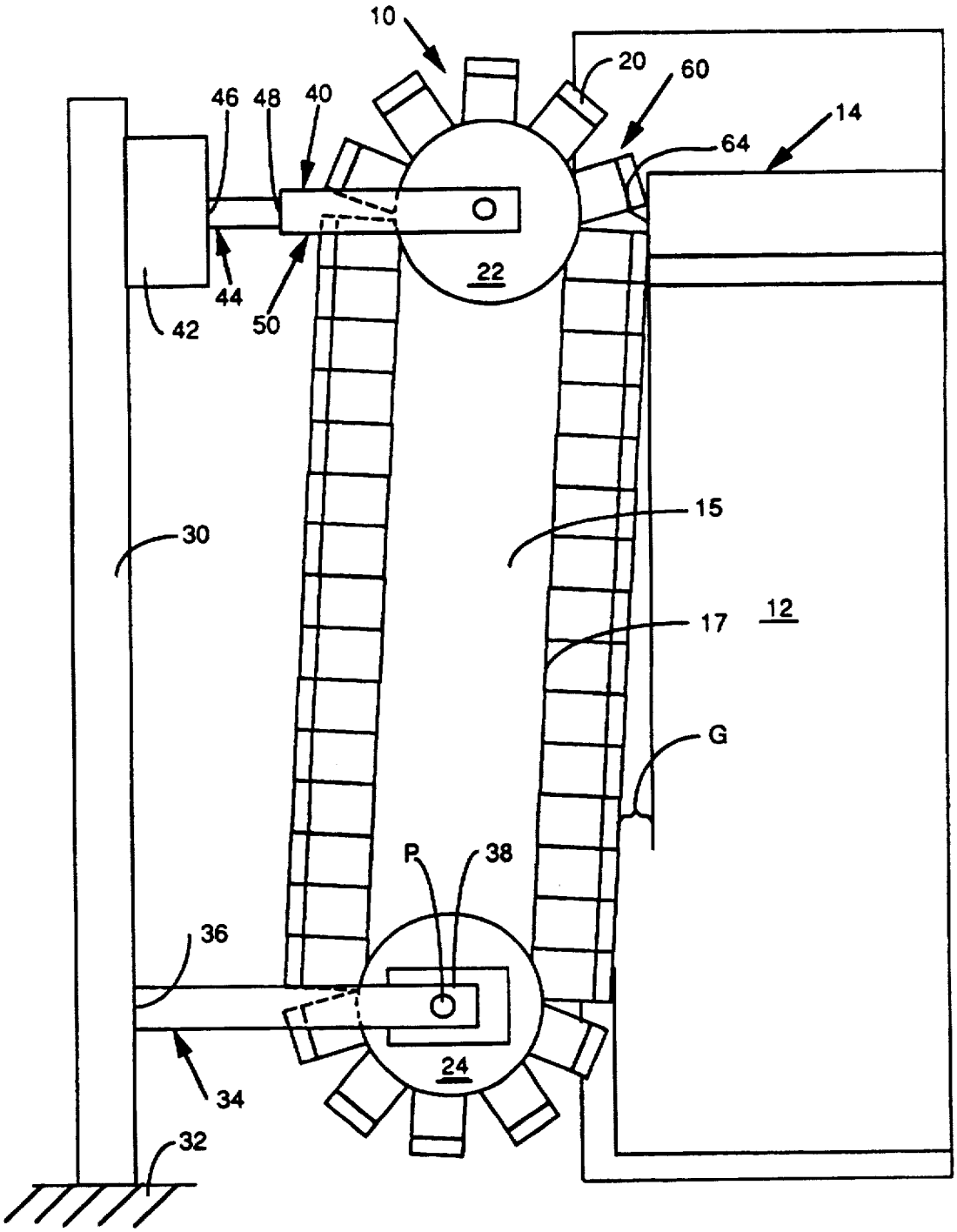
FIG. 2 is a view similar to FIG. 1 only showing the pivoting movement of the side dam of the invention.

Referring now to both FIGS. 1 and 2, the mounting of the side dam 10 to the caster will be described. The caster includes a vertical beam 30 that is attached to the floor 32 or other caster support surface. An arm 34 having one end 36 connected to the beam 30 and a second end 38 connected to lower pulley 24 fixedly secures the side dam 10 to the caster. Pulley 22, on the other hand, is connected to the beam 30 by movable mechanical means 40, which includes a cylinder 42 secured to the beam 30, a movable piston 44 having one end 46 disposed in the cylinder 42 and its opposite end 48 secured to an arm 50. Arm 50 is then connected to pulley 22.

The movable mechanical means 40 along with the fixed arm 34 allows the upper portion 60 of the side dam 10 to be pivotably mounted to the caster. As can be seen in FIG. 2, when the piston 44 is moved out from the cylinder 42, the arm 50 moves pulley 22 thus pivoting the upper portion 60 of the side dam 10 about a pivot point P on the pulley 24. In this way, the upper portion 60 of the side dam 10 can move closer to the edge 64 of the nozzle 14 to form a tight secure fit between the nozzle 14 and the side dam 10. This tight secure fit resists molten metal from leaking from the mold to between the side dam 10 and the nozzle 14.

The pivoting action of the side dam 10 is desirable because the nozzle 14 can shrink under some circumstances, such as start-up versus steady running and such shrinkage could create a gap between the nozzle 14 and the side dam 10, which leads to undesired leakage. It is also important that the side dam 10 maintain contact with the molten metal near the top of the mold 12 in order to insure a quality cast metal product without surface defects. As the metal product cools and solidifies further down in the mold 12 the need for this contact is reduced. Thus, the greater gap G further down in the mold 12 (FIG. 2) that is produced by pivoting the side dam 10 is not critical to the quality of the cast metal product. It will be appreciated that the gap G shown in FIG. 2 is exaggerated in order to better explain the invention.

The mechanical means 40 can be moved by several different mechanisms. For example, the cylinder 42 and piston 44 can be hydraulically operated or can be spring biased.

Referring now to FIGS. 3–7, an embodiment of the invention with an added feature will be discussed. As discussed above, it is desirable to pivot the upper portion 60 of the side dam 10 to create a tight secure seal between the side dam 10 and the nozzle 14. However, applying too great of a pressure of the side dam 10 against the nozzle 14 can lead to excessive frictional wear of the nozzle 14. The embodiment of FIGS. 3–7 discloses an apparatus and method that insures a tight secure seal of the side dam to the nozzle while at the same time adjusting the application pressure in order to resist excessive frictional wear of the nozzle 14 by the orbiting side dam 10.

Figure 3:
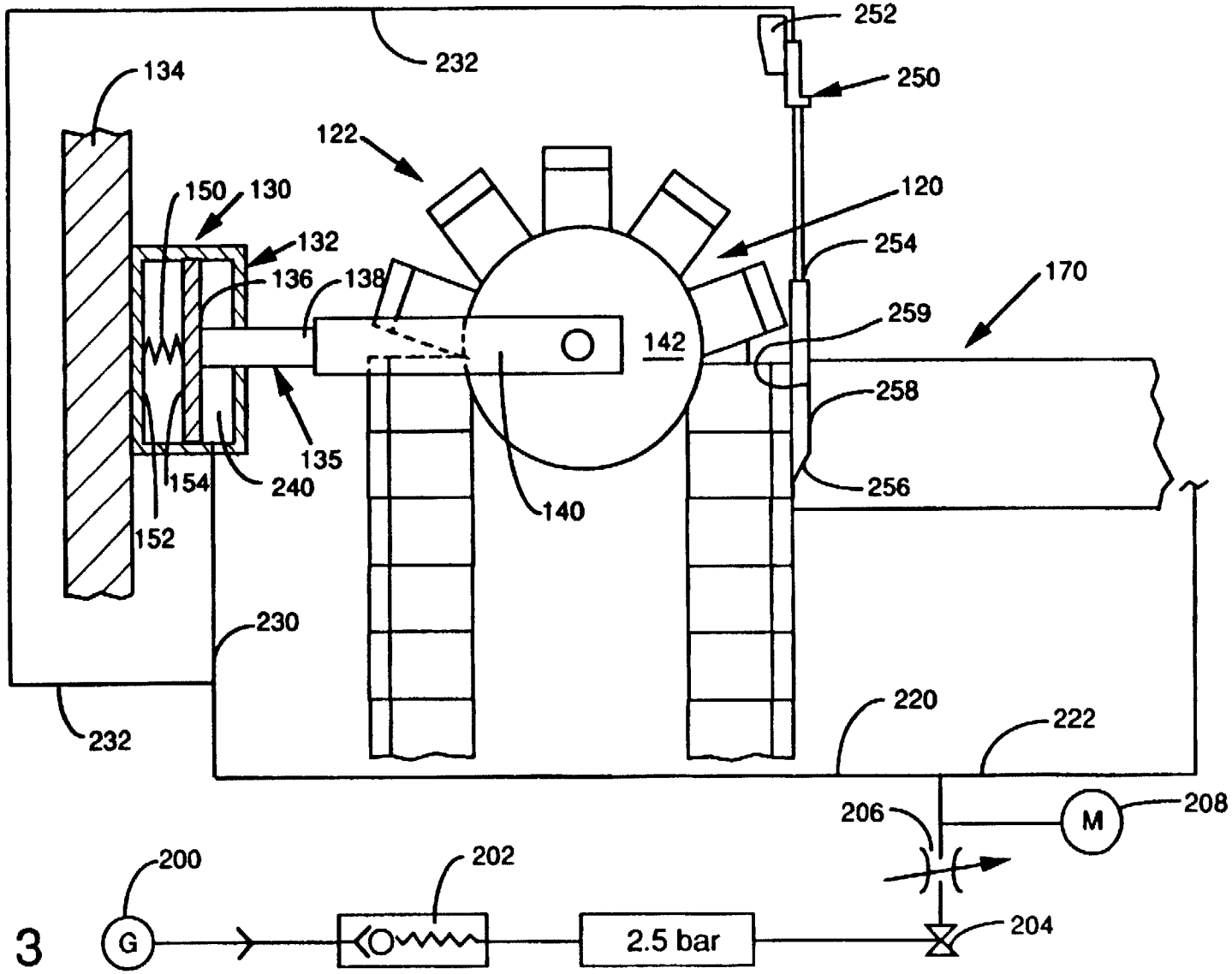
FIG. 3 is a detailed side view, partially in section, showing the mechanical means of the invention.

FIG. 3 shows a detailed view of the upper portion 120 of another embodiment of a side dam 122. In this embodiment, as in the embodiment in FIGS. 1 and 2, mechanical means 130 consists of a cylinder 132 secured to a beam 134 which is in turn connected to the floor or other caster support surface (not shown in FIG. 3). The cylinder 132 has disposed therein a piston 135 consisting of a plate 136 and a rod 138 extending from the plate 136 and out of the cylinder 132. The rod 138 is connected to arm 140 which in turn is connected to pulley 142 of the side dam 122. A spring 150 is connected between the back inside wall 152 of the cylinder 132 and the back surface 154 of the plate 136. This spring 150 biases the upper portion 120 of the side dam 122 against the nozzle 170.

In order to adjust the biasing force of the spring 150 so that the pressure of the side dam 122 against the nozzle 170 is not so great as to cause excessive, premature frictional wear of the nozzle 170, an adjustment system is provided. Referring to FIG. 3, this system consists of a gas supply means 200 which supplies gas (such as air) at 5–6 bar to a pressure reducer 202. The pressure reducer 202 reduces the pressure to about 2.5 bar, which has been found to be sufficient for the purposes of the adjustment system. The gas is then directed to a valve 204 and then a throttle 206. A pressure meter 208 is provided to measure the pressure from the throttle 206.

The gas is then delivered to side dam 122 and the opposed side dam (not shown) by respective lines 220 and 222. The operation of the system for side dam 122 is the same as the operation for the opposed side dam, so only the operation of side dam 122 needs to be explained. The gas is then introduced by two branch lines 230 and 232 to (i) a chamber 240 in the cylinder 132 and (ii) a tube 250 which is interposed between the upper portion 120 of the side dam 122 and the nozzle 170, respectively.

Figure 4:
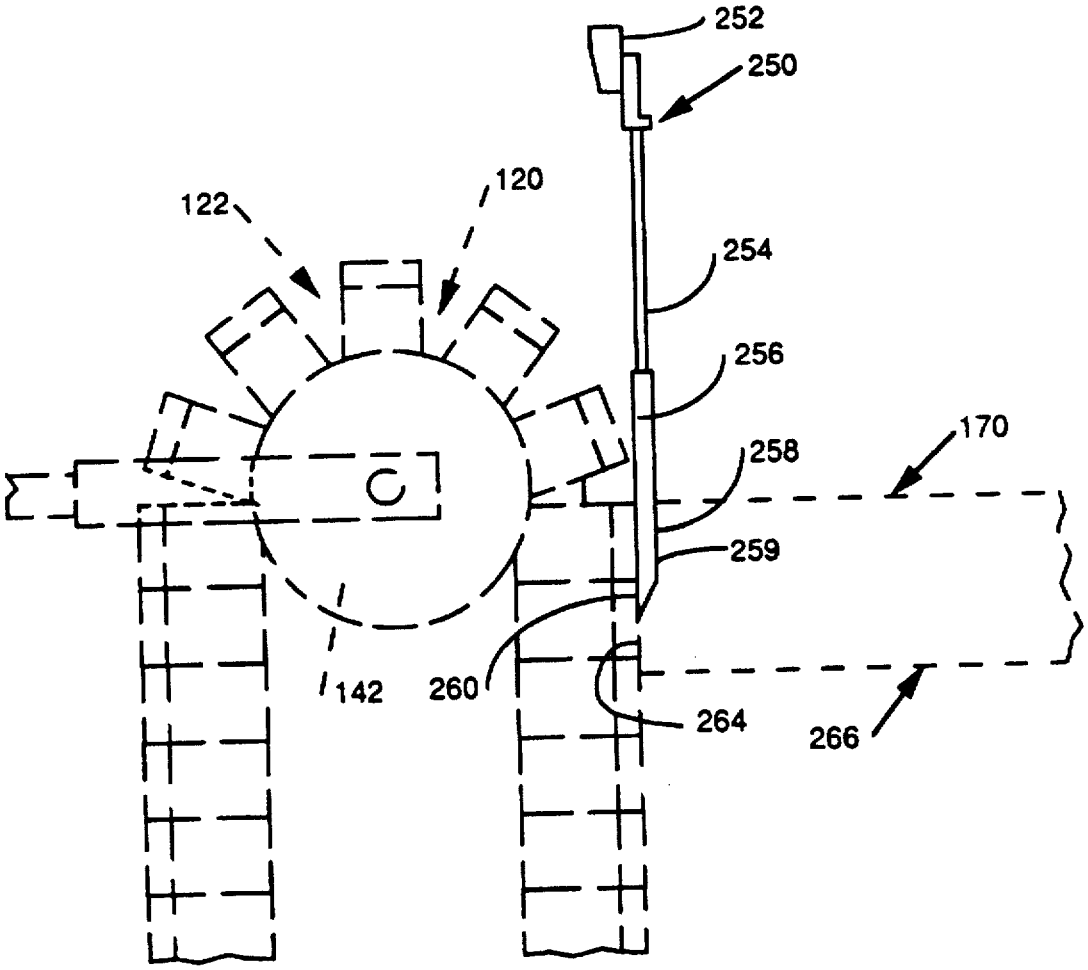
FIG. 4 is a side-elevational view of the tube of the invention.
Figure 5:
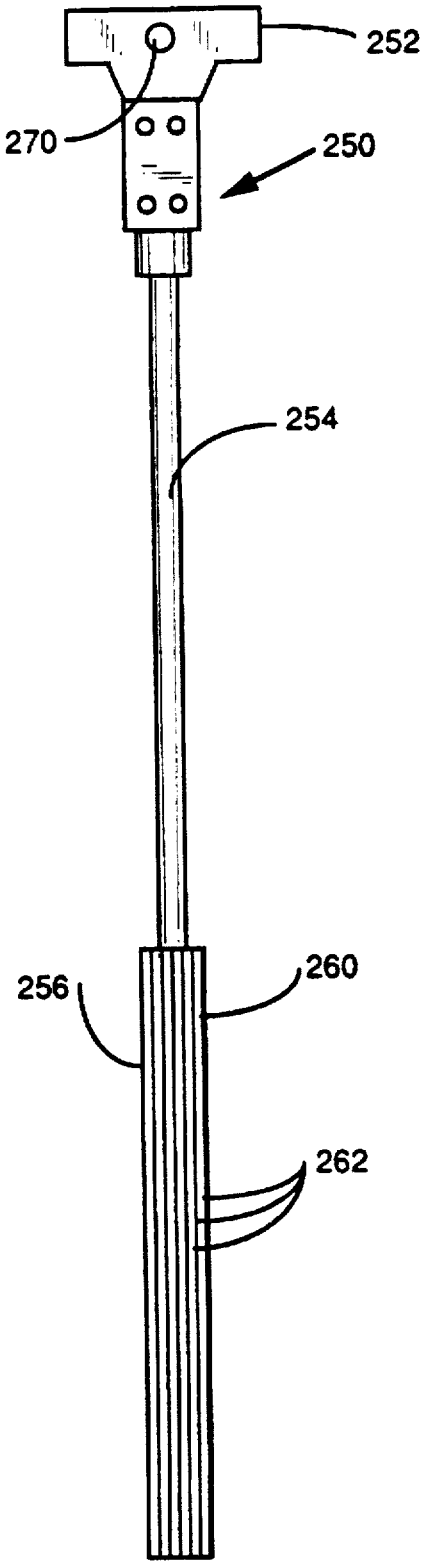
FIG. 5 is a front elevational view of the tube of the invention.

Referring particularly to FIGS. 4–7, the tube 250 of the invention will be explained. The tube 250 of the invention is interposed between the nozzle 170 and the upper portion 120 of the side dam 122. The tube 250 consists of a mounting portion 252, which is mounted to the tundish (not shown) a hollow rod 254 and a metal block portion 256 having a nozzle engaging surface 258 which is adapted to engage against edge 259 of the nozzle 170 and a side dam engaging surface 260. As shown in FIG. 5, the side dam engaging surface 260 includes tungsten carbide inserts 262 which provide a wearing surface for the tube 250 against the side dam 122. As can be seen in FIG. 4, the side dam engaging surface 260 is co-planar with the outside edge 264 of the lower portion 266 of nozzle 170. This allows for a smooth transition from the tube 250 to the nozzle 170.

Figure 6:
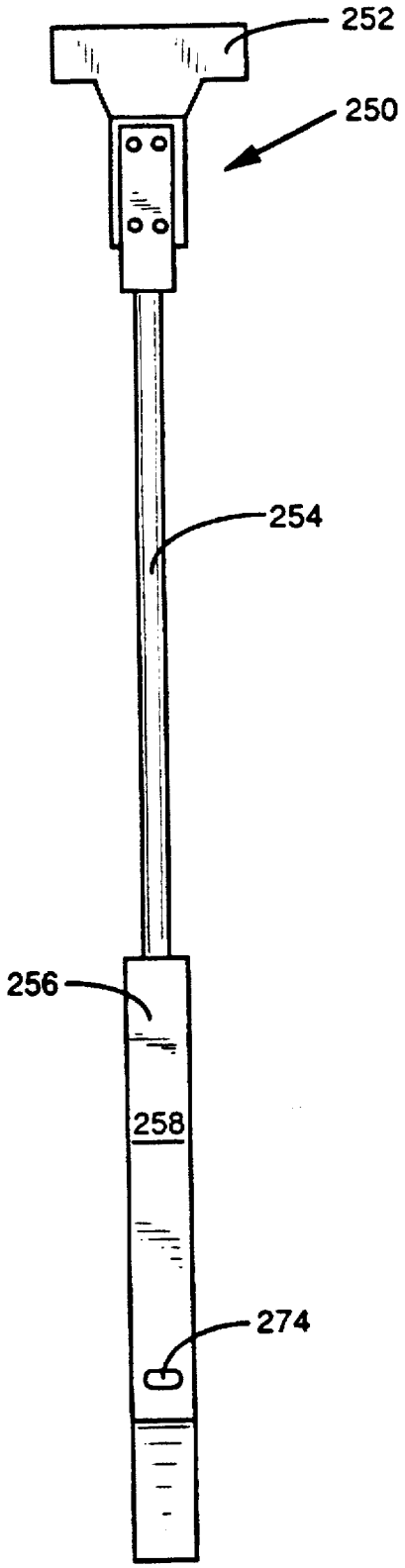
FIG. 6 is a back elevational view of the tube of the invention.
Figure 7:
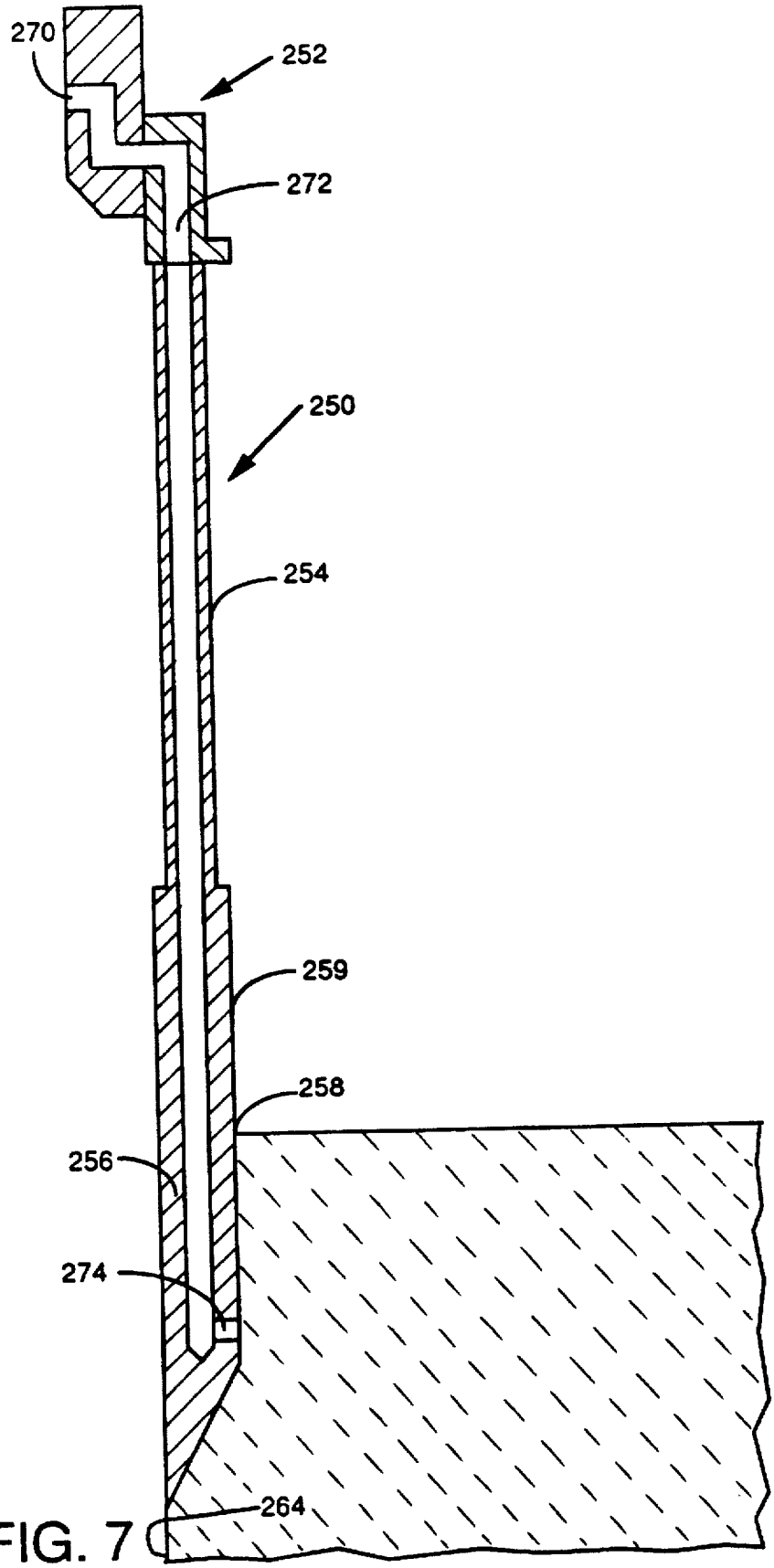
FIG. 7 is a vertical cross-sectional view of the tube of the invention.

The tube 250 has a gas entry port 270 (FIGS. 5 and 7), a gas passageway 272 (FIG. 7) and an exhaust hole 274 (FIGS. 6 and 7). The entry port 270 receives gas from the branch gas line 232 (FIG. 3) and transports the gas through the passageway and out the exhaust hole 274.

The operation of the adjusting system will now be explained with reference to FIGS. 3–7. Initially, the spring 150 fully biases the upper portion 120 of the side dam 122 against the nozzle 170. This creates an undesirably hard pressure by the side dam 122 on the outside edge 264 of the nozzle 170 which leads to undesired excessive wear and tear on the nozzle 170, which, as discussed above, is made of a refractory material.

Because of this excessive pressure, the adjustment system provides a method of reducing the biasing force of the spring 150 so that enough pressure is maintained to create a tight secure seal, while at the same time, the pressure is not so great as to cause excessive frictional wear of the nozzle 170. This is accomplished by introducing gas into chamber 240 defined by the cylinder 132 and the plate 136 of the piston 138. This gas pressure, if great enough, counteracts the biasing force of the spring 150 in order to move the upper portion 120 of the side dam 122 away from the nozzle 170 to thus relieve the pressure of the side dam 122 against the nozzle 170.

It will be appreciated that the gas is also, at the same time, entering the passageway 272 of the tube 250. As more gas is introduced into the chamber 240, the upper portion 120 of the side dam 122 moves away from the tube 250, and thus the nozzle engaging surface 258 of the tube 250 is not pressed against the outside edge 259 of the nozzle 170. Referring to FIG. 7, this means that exhaust hole 274 becomes uncovered, and thus gas can flow freely through port 270 and passageway 272 and out the exhaust hole 274.

Because the gas can flow freely out of the exhaust hole 274, less gas enters into the chamber 240. This means that the spring biasing force can overcome the gas pressure in the chamber 240 and thus moving the side dam 122 towards the tube 250, thus again covering the exhaust hole 274. It will be appreciated that there will be a certain gas pressure level which will place the system in equilibrium. This adjustment process usually does not take a long time, as the system quite quickly finds the equilibrium desired pressure.

Although the preferred embodiment shows a side dam that is pivotably mounted to a caster, it will be appreciated that the side dam can be constructed to move translationally by using the mechanical means, such as by mounting the side dam on rails.

It will be appreciated that the invention provides a side dam pivotably mounted to a caster so that a tight secure seal is created between the nozzle of the caster and the side dam. The invention further provides an adjustment system whereby the pressure of side dam against the nozzle can be adjusted so as to provide a tight secure seal of the nozzle to the side dam, while at the same time, adjusting the pressure so that it is not so great as to cause excessive undesired frictional wear of the nozzle.

While specific embodiments of the invention have been disclosed, it will be appreciated by those skilled in the art that various modifications and alterations to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed is:

1. A side dam for a caster having a nozzle for delivering molten metal into a mold for subsequent solidification therein into a metal product, said mold including (i) a molten metal entry portion disposed adjacent said nozzle for receiving said molten metal into said mold, said molten metal entry portion having a first average thickness and (ii) a metal product exit portion opposite said molten metal entry portion where said metal product exits said mold, said metal product exit portion having a second average thickness, said side dam being movably mounted and having an entry end and exit end with said entry end pivotable with respect to said exit end wherein said first average thickness is reduced in dimension relative to said second average thickness so that said side dam can be securely sealed against said nozzle to resist said molten metal in said mold from leaking between said nozzle and said side dam.

2. The side dam of claim 1, including mechanical means for moving the entry end of said side dam and means for fixedly securing said exit end to the caster.

3. The side dam of claim 2, wherein said mechanical means includes a cylinder, a piston operatively associated with said cylinder and an arm having one portion connected to said piston and another portion connected to said side dam, whereby movement of said piston relative to said cylinder causes said side dam to move.

4. The side dam of claim 1, wherein said side dam is pivotably mounted.

5. A side dam for a caster having a nozzle for delivering molten metal into a mold, said side dam being movably mounted so that said side dam can be securely sealed against said nozzle to resist said molten metal in said mold from leaking between said nozzle and said side dam;

mechanical means for moving said side dam;

said mechanical means includes a cylinder, a piston operatively associated with said cylinder and an arm having one portion connected to said piston and another portion connected to said side dam, whereby movement of said piston relative to said cylinder causes said side dam to move; and a spring disposed in said cylinder, said spring biasing said piston and said arm so that said side dam presses against said nozzle.

6. The side dam of claim 5, wherein said cylinder including a chamber for receiving a gas from a gas supply means, said gas creating a gas pressure which, if great enough, can counteract the biasing force of said spring and thus move said side dam away from said nozzle.

7. The side dam of claim 6, including a tube disposed between said side dam and said nozzle, said tube having a gas receiving end for receiving gas from said gas supply means, a passageway and an exhaust hole, whereby a desired pressure of said side dam against said tube and therefore said nozzle is created by introducing said gas from said gas supply means to both said chamber and said tube.

8. The side dam of claim 7, including a throttle for controlling said gas pressure in said chamber and said tube.

9. The side dam of claim 8, wherein said tube includes a side dam engaging surface having a portion against which said side dam engages.

10. The side dam of claim 9, wherein said outer wall includes tungsten carbide inserts to increase the useful life of said outer wall and said tube.

11. A side dam for a caster having a nozzle for delivering molten metal into a mold for subsequent solidification therein into a metal product, said mold including (i) a molten metal entry portion disposed adjacent said nozzle for receiving said molten metal into said mold, said molten metal entry portion having a first average thickness and (ii) a metal product exit portion opposite said molten metal entry portion where said metal product exits said mold, said metal product exit portion having a second average thickness, said side dam comprising a frame, orbiting means mounted to said frame and a plurality of elements connected to said orbiting means, said side dam being movably mounted and having an entry end and exit end with said entry end pivotable with respect to said exit end wherein said first average thickness is reduced in dimension relative to said second average thickness so that said side dam can be securely sealed against said nozzle to resist said molten metal in said mold from leaking between said nozzle and said side dam.

12. The side dam of claim 11, including mechanical means for moving said side dam.

13. The side dam of claim 12, wherein said mechanical means includes a cylinder, a piston operatively associated with said cylinder and an arm having one portion connected to said piston and another portion connected to said side dam, whereby movement of said piston relative to said cylinder causes said side dam to move.

14. The side dam of claim 11, wherein said exit end of said side dam is fixedly secured to said caster and said entry end is pivotably mounted with respect to said exit end.

15. A side dam for a caster having a nozzle for delivering molten metal into a mold, said side dam comprising a frame, orbiting means mounted to said frame and a plurality of elements connected to said orbiting means, said side dam being movably mounted so that said side dam can be securely sealed against said nozzle to resist said molten metal in said mold from leaking between said nozzle and said side dam;

mechanical means for moving said side dam;

said mechanical means includes a cylinder, a piston operatively associated with said cylinder and an arm having one portion connected to said piston and another portion connected to said side dam, whereby movement of said piston relative to said cylinder causes said side dam to move; and a spring disposed in said cylinder, said spring biasing said piston and said arm so that said side dam presses against said nozzle.

16. The side dam of claim 15, wherein p1 said cylinder including a chamber for receiving a gas from a gas supply means, said gas creating a gas pressure which, if great enough, can counteract the biasing force of said spring and thus move said side dam away from said nozzle.

17. The side dam of claim 16, including a tube disposed between said side dam and said nozzle, said tube having a gas receiving end for receiving gas from said gas supply means, a passageway and an exhaust hole, whereby a desired pressure of said side dam against said tube and therefore said nozzle is created by introducing said gas from said gas supply means to both said chamber and said tube.

18. The side dam of claim 17, including a throttle for controlling said gas pressure in said chamber and said tube.

19. The side dam of claim 18, wherein said tube includes a side dam engaging surface having a portion against which said side dam engages.

20. The side dam of claim 19, wherein said outer wall includes tungsten carbide inserts to increase the useful life of said outer wall and said tube.

21. A method of sealing a side dam to a nozzle of a caster including a mold for casting molten metal into a metal product, said mold including (i) a molten metal entry portion disposed adjacent said nozzle for receiving said molten metal into said mold, said molten metal entry portion having a first average thickness and (ii) a metal product exit portion opposite said molten metal entry portion where said metal product exits said mold, said metal product exit portion having a second average thickness, said method comprising:

moving said side dam wherein said first average thickness is reduced in dimension relative to said second average thickness in order to securely seal said side dam against said nozzle so that leakage of said molten metal from said mold to between said side dam and said nozzle is resisted.

22. The method of claim 21, including providing mechanical means for moving said side dam.

23. The method of claim 21, including employing as said side dam (i) a frame, (ii) orbiting means mounted to said frame and (iii) a plurality of elements connected to said orbiting means.

24. The method of claim 21, including pivotably mounting said side dam; and pivoting said side dam in order to seal said side dam against said nozzle.

25. A method of sealing a side dam to a nozzle of a caster including a mold for casting molten metal into a metal product, said method comprising:

moving said side dam in order to securely seal said side dam against said nozzle so that leakage of said molten metal from said mold to between said side dam and said nozzle is resisted;

providing mechanical means for moving said side dam; and adjusting the pressure of said side dam against said nozzle so that a secure seal is created between said side dam and said nozzle while at the same time said pressure is not so great as to cause undesired friction al wear of said nozzle.

26. The method of claim 25, including employing as said mechanical means (i) a cylinder secured to said caster, said cylinder defining a chamber for receiving a gas from a gas supply means; (ii) a piston operatively associated with said cylinder; (iii) an arm having one portion connected to said piston and another portion connected to said side dam; (iv) a spring disposed in said cylinder, said spring biasing said piston and said arm so that said side dam presses against said nozzle; and (v) a tube disposed between said side dam and said nozzle, said tube having a gas receiving end for receiving gas from said gas supply means, a passageway and an exhaust hole; and introducing gas from said gas supply means into both said chamber and said tube so that said side dam is securely sealed to said nozzle while at the same time not so tightly sealed so that undesired excessive frictional wear is caused to said nozzle.

27. The method of claim 26, including before introducing gas into both said chamber and said tube, said spring biases said side dam tightly against said nozzle; and subsequently introducing into said chamber and said tube said gas wherein said gas is restricted in flowing out said exhaust hole thus causing an excess amount of said gas to be introduced into said chamber so that the pressure of said gas in said chamber overcomes said biasing force of said spring to move said side dam away from said nozzle so that excess frictional wear of said nozzle is resisted.

28. The method of claim 27, including after said biasing force is overcome by said gas pressure in said chamber, said exhaust hole is no longer covered and thus said gas in said tube flows freely out said exhaust hole thus reducing said gas pressure in said chamber and moving said side dam towards said nozzle.

29. The method of claim 28, including creating an equilibrium between said biasing force of said spring and the pressure of said gas flowing out of said exhaust hole.

* * * * *

UNITED STATES PATENT AND TRADEMARK OFFICE

CERTIFICATE OF CORRECTION

PATENT NO. : 5,787,968

DATED : August 4, 1998

INVENTOR(S) : WILHELM F. LAUENER

It is certified that error appears in the above-identified patent and that said Letters Patent is hereby corrected as shown below:

Claim 16, line 1, delete "pl".

Signed and Sealed this

Twenty-second Day of June, 1999

*Attest:*

Q. TODD DICKINSON

*Attesting Officer*

*Acting Commissioner of Patents and Trademarks*